US005620110A

United States Patent [19]

Delatte

[11] Patent Number: 5,620,110

[45] Date of Patent: Apr. 15, 1997

[54] CRYOBIOLOGICAL CONTAINER

[75] Inventor: Daniel Delatte, Saint Maur, France

[73] Assignee: L'Air Liquide, Societe Anonyme Pour L'Etude et L'Exploitation des Procedes Georges Claude, Paris Cedex, France

[21] Appl. No.: 323,276

[22] Filed: Oct. 14, 1994

[30] Foreign Application Priority Data

Oct. 14, 1993 [FR] France ..... 93 12210

[51] Int. Cl.[6] ..... B65D 90/04

[52] U.S. Cl. ..... 220/437; 336/232; 220/466; 220/446; 220/410

[58] Field of Search ..... 220/565, 901, 220/466, 445, 446, 448, 421, 408, 410, 264, 335, 23.83, 23.86, 420, DIG. 16, 263, 435–440; 211/131; 312/305; 215/230; 366/220, 232, 233

[56] References Cited

U.S. PATENT DOCUMENTS

| | | | |
|---|---|---|---|
| 128,856 | 7/1872 | Condon | 366/232 |
| 1,092,039 | 3/1914 | Goldstein | 220/335 |
| 1,136,235 | 4/1915 | Jones | 220/263 |
| 1,371,336 | 3/1921 | Welty | 220/420 |
| 1,675,258 | 6/1928 | Dawsey | 220/420 |
| 2,190,606 | 2/1940 | Pedder | 215/230 |
| 2,194,719 | 3/1940 | Parrish | 220/437 |
| 2,485,302 | 10/1949 | Lukas | 366/232 |
| 2,534,286 | 12/1950 | Maitzen | 220/437 |
| 2,552,832 | 5/1951 | Ahlstrand et al. . | |
| 2,695,729 | 11/1954 | Hornish . | |
| 3,043,466 | 7/1962 | Gardner | 220/445 |
| 3,088,787 | 5/1963 | Perkins . | |
| 3,280,778 | 10/1966 | Leathard | 220/445 |
| 3,565,505 | 2/1971 | Hans-Georg Quapp | 312/305 |
| 4,301,717 | 11/1981 | Knees | 366/220 |
| 4,595,113 | 6/1986 | Fafflok et al. | 220/23.83 |
| 4,625,892 | 12/1986 | Corlin, Jr. | 220/435 |
| 4,788,999 | 12/1988 | Dalpane | 220/335 |
| 4,826,035 | 5/1989 | Suzuki et al. | 220/203.1 |
| 5,168,725 | 12/1992 | Margolin . | |

FOREIGN PATENT DOCUMENTS

| | | | |
|---|---|---|---|
| 252920 | 11/1948 | Switzerland | 220/420 |
| 518301 | 2/1940 | United Kingdom . | |
| 1314261 | 4/1973 | United Kingdom | 220/439 |

*Primary Examiner*—Stephen J. Castellano
*Attorney, Agent, or Firm*—Young & Thompson

[57] ABSTRACT

The cryobiological container comprises a double walled reservoir structure (1) comprising an internal shell (2) having a cylindrical side wall (4) and a bottom wall (5) and forming an internal volume accessible through an upper opening (6) of the same diameter as the cylindrical wall (4), the bottom wall (5) comprising a central support (7) adapted to receive a pivot (8) fixed to the bottom (9) of a rotatable storage container (10) adapted to be received within the internal shell (4) and having a cylindrical side wall (11) of a diameter slightly less than that of the lateral wall (4) of the internal shell (2) and provided at its periphery with a plurality of guiding and centering rollers (15) coacting with the side wall (4) of the internal shell (2). The access opening (6) is preferably closable by a plug carried by a cover structure pivotably mounted on the reservoir structure (1).

17 Claims, 2 Drawing Sheets

CRYOBIOLOGICAL CONTAINER

The present invention relates to cryobiological containers, of the type comprising a double shell reservoir structure comprising an internal shell having a cylindrical side wall and a bottom wall and forming an internal volume accessible through an upper opening of the same diameter as that of the cylindrical wall and closable by a plug.

Such containers, generally of large capacity, of typically 150–1000 liters, serve for the storage in a cryogenic liquid, typically nitrogen, of biological products disposed in pockets, canisters or in containers with drawers such as described in U.S. Pat. No. 5,226,715 in the name of the applicant.

Because of their fairly large sizes, these containers pose problems of access to the stored products as well as correspondingly, because of the very great refrigeration therein, of safety for the operators.

The present invention has for its object to provide an improved cryobiological container having, for a reduced cost of fabrication, a greatly improved energy balance and increased safety.

To do this, according to a characteristic of the invention, the bottom wall of the internal reservoir comprises a central bearing adapted to coact with a pivot secured to a bottom of a rotatable cylindrical storage container adapted to be received coaxially within the internal shell and having a cylindrical side wall of a diameter slightly less than that of the side wall of the internal shell.

According to other particular characteristics of the invention:

- the side wall of the rotatable container comprises, at its periphery, a plurality of rollers with vertical axes coacting with the side wall of the internal shell and, preferably, a plurality of manual actuating members to rotate this container within the internal shell, about its vertical axis;
- the plug is carried by a cover structure supported pivotably at one of its ends on the reservoir structure, preferably having a display panel of the operating parameters of the container and associated with handling and assistance means for raising the structure of the cover.

With the arrangements according to the invention, the opening and closing of the cover is easily effected and the operator can, by simple rotation of the storage container, bring to its opening the products disposed at the other end of the container without having to tilt the access opening. Moreover, the reservoir structure can be used as desired with or without the rotatable container, as the users require.

There are also known cryobiological containers whose internal reservoir, accessible through a small upper opening, comprises permanently at least one rotatable vessel carried by a rotatable hub on a central fixed shaft mounted in the internal reservoir, the rotation of the plate taking place by a key engaged in an upper end of the hub. Because of difficult access to the stored products, and particularly the difficulties of rotating the turnable plate, these types of containers have progressively given way to containers with so-called "total" openings, to which the present invention brings significant improvements.

Other characteristics and advantages of the present invention will become apparent from the following description of embodiments given by way of illustration but not in a limiting sense, with respect to the accompanying drawings, in which.

Figure 1:
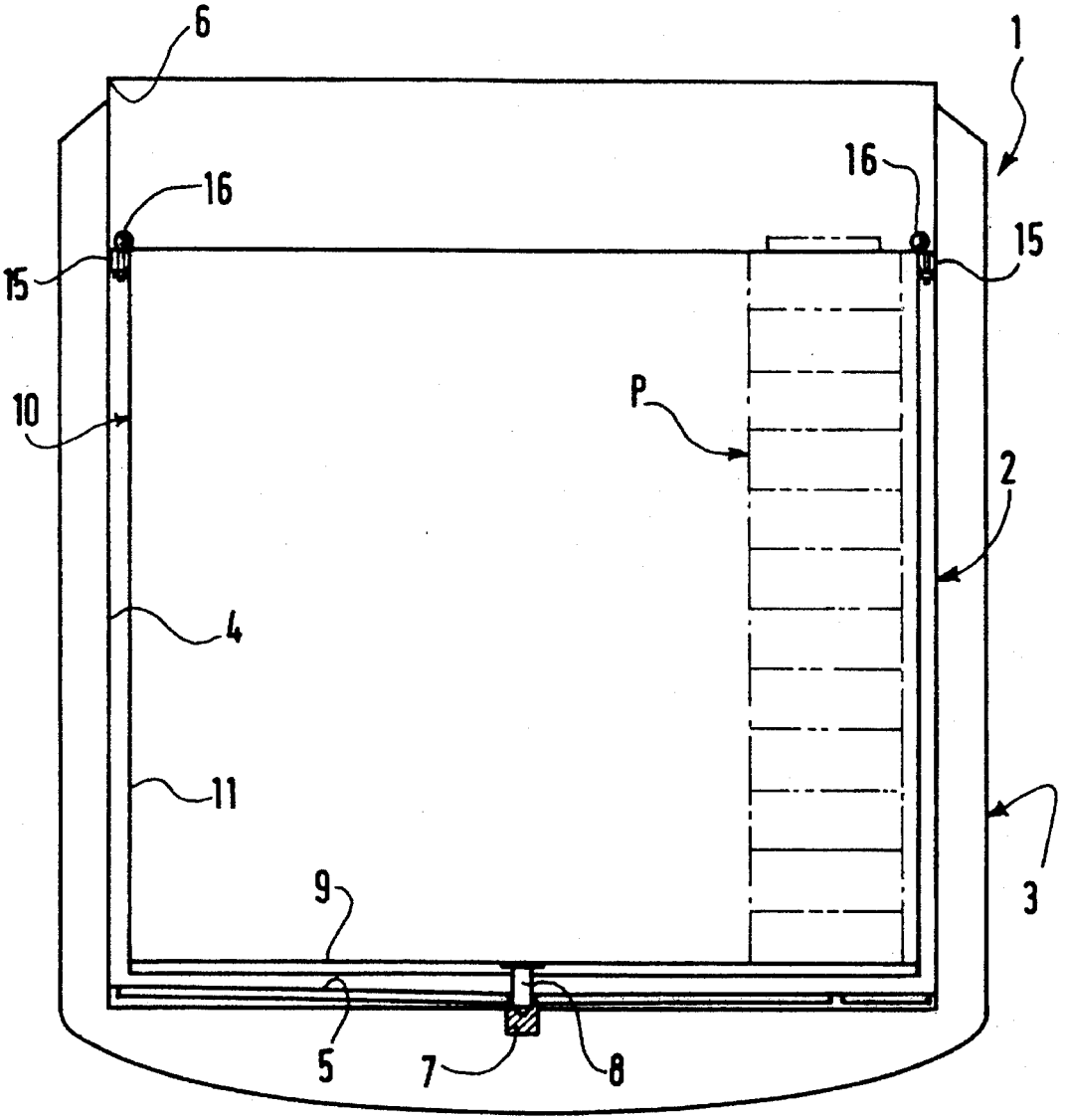
FIG. 1 is a schematic vertical cross-sectional view of a reservoir structure of a container according to the invention.

In FIG. 1 will be seen the principal elements of a cryogenic reservoir structure 1 with a double shell, comprising an internal shell 2 and an external shell 3 surrounding the internal shell at a distance from this latter, the space between the two shells 2 and 3 being under vacuum. In this cryobiological container with a total opening, the internal reservoir 2 has a generally cylindrical configuration with a cylindrical side wall 4 closed at its lower end by a bottom 5 and opening upwardly through an access opening 6 provided to be of the same diameter as that of the cylinder of the side wall 4. According to the invention, the bottom 5 of internal reservoir 2 comprises centrally an axial bearing 7 having, in its upper end, a recess to receive a vertical pivot 8 extending downwardly from a horizontal bottom of a cylindrical vessel 10 disposed within the internal shell 4. The vessel 10 comprises a cylindrical side wall 11 which is slightly smaller in diameter than the side wall 4 of the internal reservoir 2 and which opens freely upwardly at a vertical distance relative to the access opening 6 so as not to interfere with a cylindrical plug 12 adapted to close opening 6 and to insulate from the ambient the internal volume of the internal reservoir.

Figure 2:
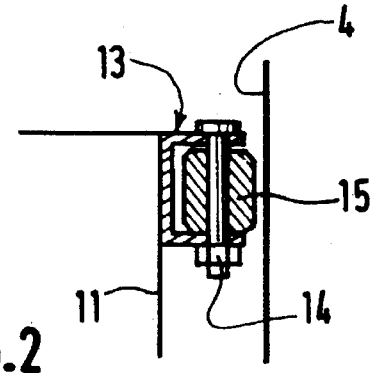
FIG. 2 is a fragmentary enlarged view, in a vertical plane, of a guide and centering roller of the rotatable vessel of the container of FIG. 1.
Figure 3:
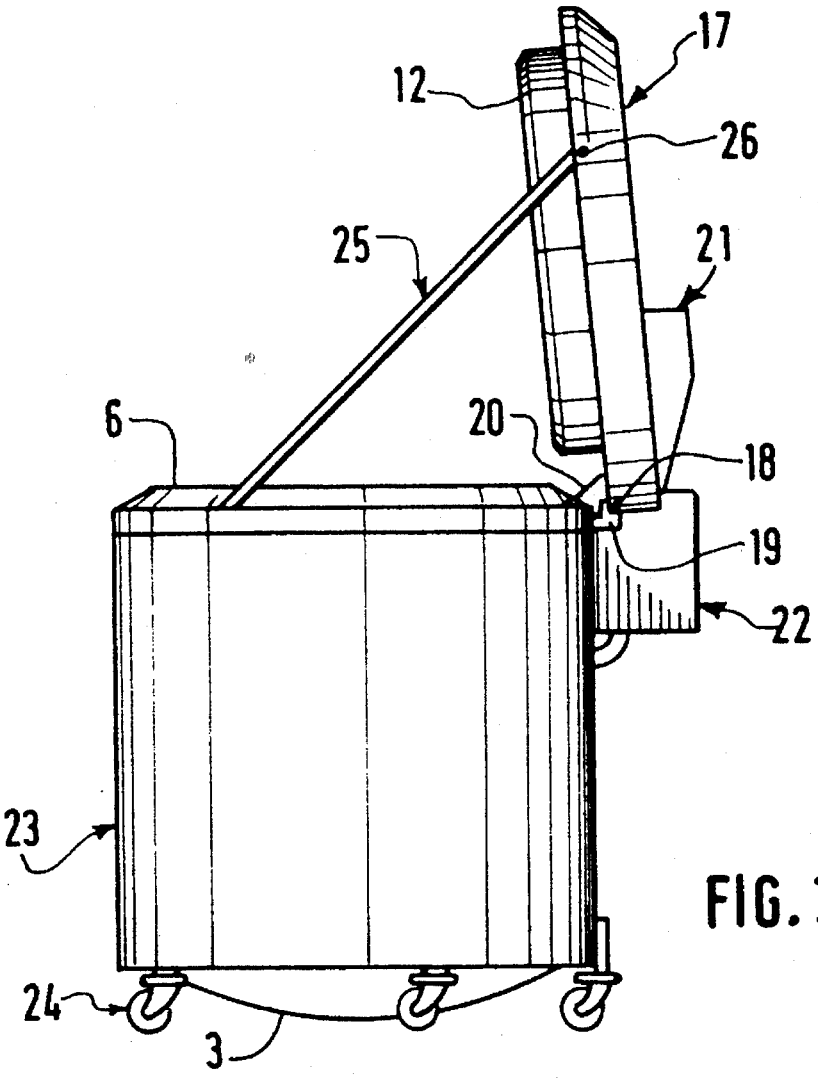
FIG. 3 is a schematic side view of a container according to the invention in its open condition, with the cover in open position.
Figure 4:
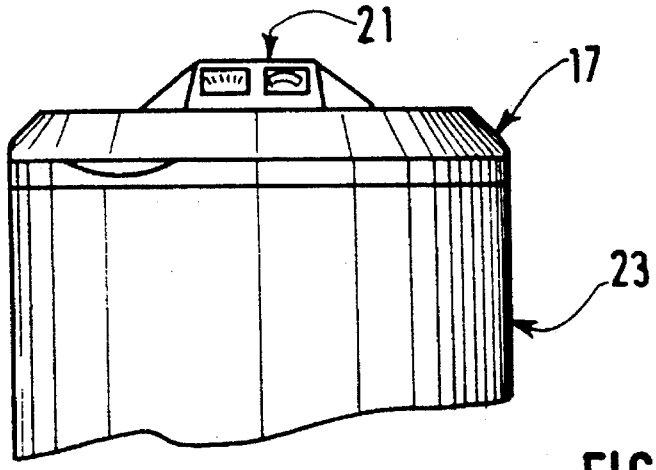
FIG. 4 is a fragmentary front view of the container of FIG. 3 with the cover closed.

As is better seen in FIG. 2, on the upper end of the side wall 11 is mounted peripherally an angular U-shaped profile 13 in which are mounted vertical axles 14 of biconical rollers 15 spaced angularly entirely about the lateral wall 11. The radial dimensions of the U-shaped profile 13 of the rollers 15 are determined so as to leave a slight play between the periphery of the rollers 15 and the side wall 4 of the internal reservoir 2. It will be understood that in this way, by simply positioning the receptacle 10 in the internal reservoir 2 with the pivot 8 received in the recess of the bearing 7, the vessel 10 will be centered and guided by the rollers 15 and can be easily turned in rotation about its vertical axis because of the low friction between the pivot 8 and its bearing 7. According to one aspect of the invention, to facilitate the rotation of the vessel 10, the upper edge of this latter comprises a series of lugs or gripping handles 16 that are angularly spaced apart and preferably mounted on the upper flange of the U-shaped profile 13. The radial dimensions of the lugs or handles 16 are determined so as not to impede, even locally, the upper access opening of the vessel 10. In FIG. 1, there is shown by way of example the positioning in the vessel 10 of a basket P for cryobiological boxes. According to the version of the container without vessel 10, the bottom plate 5 is simply covered with a horizontal bottom plate (not shown) forming a storage surface for the products to be stored within the internal shell According to another aspect of the invention, as shown in FIGS. 3 and 4, the plug 12 is carried by a cover structure 17 mounted pivotably on one of its ends about a horizontal axis 18. The raising of the cover structure 17 is assisted by assistance means such as pneumatic jacks 20 or springs associated with the pivot 18. Modern containers being provided with display devices of operating parameters of the container, particularly the cryogenic liquid level and the temperature within the internal reservoir, according to one aspect of the invention, the display casing 21 is mounted on the upper surface of the cover structure 17, preferably toward the rear of this latter, to avoid projections of cryogenic liquid, particularly during withdrawal of products from the container, as well as possible shocks from the products placed in or removed from the container, particularly the baskets.

As is seen in FIG. 3, the container according to the invention comprises at its rear a casing 22 sheltering particularly the elements of the filling and inspection system for the level of the container and forming a rear abutment ensuring that, when the container is disposed against a wall, the simple opening of the cover structure 17 will not be impeded.

The container according to the invention can be supplied "stripped", with the external reservoir polished or, as shown in FIGS. 3 and 4, in an up-ended position for a parallelepipedal cover 23 borne by the reservoir structure and exposing, at the lower portion of the container, the rollers 24 for displacement mounted on the base of the external reservoir 3.

In the up-ended version, the manipulation handle of the structure of cover 17 is preferably replaced by an elongated manipulating rod or bar 25 having one end connected articulately, at 26, to the cover structure 17, and whose other end extends to within the space between the external reservoir 3 and the cover 23 and comprises a stop member coacting with the cover 23 to limit the opening of the cover structure 17 to a predetermined angular position. This arrangement permits opening the bottom of the cover structure without requiring contact with a cold zone of this latter, for example the plug 12, and closing it again without having to tilt above the opening of the access 6 of the container.

In the container that has been described, the reservoirs 2 and 3 as well as the vessel 10 are typically of stainless steel, the vessel 10 being adapted to be of aluminum, the plug 12 of molded polyurethane foam with a skin reinforced with glass fibers, the cover structure 17 being plastic material and the cover 23 of painted steel sheet.

Although the present invention has been described with respect to particular embodiments, it is not thereby limited but on the contrary is susceptible to modifications and variations which will be apparent to those skilled in the art.

I claim:

1. In a cryobiological container comprising a double shell reservoir structure with a vertical axis, comprising an internal shell having a cylindrical side wall and a bottom wall and forming an internal volume accessible through an upper opening of the same diameter as that of the cylindrical wall and closable by a plug; wherein the improvement comprises a central bearing on the bottom wall engaged with a pivot fixed to a bottom of a rotatable cylindrical storage vessel with a vertical axis disposed coaxially within the inner shell and having a cylindrical side wall of a diameter slightly less than that of the side wall of the internal shell, and wherein the side wall of the rotatable receptacle comprises at its periphery a plurality of rollers with vertical axes coacting with the side wall of the inner shell.

2. Container according to claim 1, wherein the plug is carried by a cover structure supported articulatedly at one of its ends on the reservoir structure.

3. Container according to claim 2, further comprising a panel for displaying the operative parameters of the container, disposed on the cover structure.

4. Container according to claim 2, which further comprises means for assisting in raising the cover structure.

5. Container according to claim 2, which further comprises a peripheral cover carried by the reservoir structure.

6. Container according to claim 5, which further comprises at least one rod for manipulating the cover structure having one end hingedly connected to the structure of the cover and whose other end coacts with the cover to limit the angle of opening of the cover structure.

7. Container according to claim 1, wherein the rotatable receptacle comprises, at its upper end, a plurality of manual actuating members for rotating the receptacle within the internal shell.

8. Container according to claim 7, wherein said manual actuating members are mounted axially on a peripheral collar provided on the upper end of the side wall of the rotatable vessel and on which are mounted axles of the rollers.

9. Container according to claim 1, wherein the rotatable vessel is of stainless steel.

10. A low-temperature storage container comprising a double shell outer reservoir structure having a vertical axis and including an inner shell having a cylindrical side wall, a bottom wall and an upper open end of a same diameter as the side wall and defining an inner volume accessible through the upper open end, a cover structure for closing the open end, supported on the outer reservoir structure and movable between an open position and a closed position, and an inner cylindrical storage vessel having a cylindrical side wall, a bottom wall and an upper open end, the inner storage vessel being removably co-axially disposed within the inner volume and rotatably supported by the inner shell, the cylindrical side wall of the inner storage vessel having a diameter slightly less than that of the cylindrical side wall of the inner shell, and the inner storage vessel being rotatably supported on a pivot means arranged only centrally between the bottom wall of the inner storage vessel and the bottom wall of the inner shell.

11. The container of claim 10, wherein the cover structure is hingedly supported on a side portion of the reservoir structure.

12. The container of claim 11, further comprising means for assisting in raising the cover structure.

13. The container of claim 11, wherein the cover structure carries at least one display unit for displaying at least data representative of temperatures within the inner volume.

14. The container of claim 10, comprising guiding means for assisting in rotating the inner storage vessel arranged between the cylindrical side wall of the inner vessel and the cylindrical side wall of the inner shell.

15. The container of claim 14, wherein said means for assisting in rotating the inner storage vessel comprise rollers rotatable about vertical axes.

16. The container of claim 14, wherein the cylindrical side wall of the inner storage vessel further comprises means for manually rotating the inner storage vessel relative to the outer reservoir structure.

17. The container of claim 10, wherein the inner volume has a capacity between 150 and 1,000 liters.

* * * * *